US006769372B2

(12) United States Patent
Sato et al.

(10) Patent No.: US 6,769,372 B2
(45) Date of Patent: Aug. 3, 2004

(54) LIGHT TRANSPORT SHIP

(75) Inventors: Kazunori Sato, Tokyo (JP); Katsuyoshi Takekuma, Tokyo (JP); Takehito Tomoi, Tokyo (JP); Kenichi Inoue, Tokyo (JP); Shigeo Ohnishi, Tokyo (JP)

(73) Assignee: Shipbuilding Research Centre of Japan, Tokyo (JP)

( * ) Notice: Subject to any disclaimer, the term of this patent is extended or adjusted under 35 U.S.C. 154(b) by 0 days.

(21) Appl. No.: 10/232,465

(22) Filed: Aug. 30, 2002

(65) Prior Publication Data

US 2003/0061976 A1 Apr. 3, 2003

(30) Foreign Application Priority Data

Oct. 1, 2001 (JP) ..... 2001-305739

(51) Int. Cl.[7] ..... B63B 3/00

(52) U.S. Cl. ..... 114/65 R; 114/121; 440/54; 405/200

(58) Field of Search ..... 114/65 R, 121, 114/77 R, 40, 41, 42; 440/49, 51, 53, 54; 405/200

(56) References Cited

U.S. PATENT DOCUMENTS

| | | | | | |
|---|---|---|---|---|---|
| 2,302,795 | A | | 11/1942 | Noble | 440/54 |
| 3,076,428 | A | * | 2/1963 | Shipley | 440/54 |
| 3,253,565 | A | * | 5/1966 | Mangone | 114/65 R |
| 3,807,347 | A | * | 4/1974 | Baldwin | 440/54 |
| 3,850,125 | A | * | 11/1974 | Anders | 114/40 |
| 4,046,092 | A | | 9/1977 | Törnqvist | 114/56 |
| 4,573,929 | A | * | 3/1986 | Savikurki et al. | 440/54 |
| 4,744,320 | A | * | 5/1988 | Johnston | 114/65 R |
| 5,199,368 | A | * | 4/1993 | Souda | 114/65 R |
| 5,522,335 | A | | 6/1996 | Veronesi et al. | 114/151 |
| 5,632,658 | A | * | 5/1997 | Chen et al. | 440/49 |
| 5,711,239 | A | | 1/1998 | Ramde | 114/56 |
| 5,980,159 | A | * | 11/1999 | Kazim | 405/200 |
| 6,165,031 | A | * | 12/2000 | Lonngren et al. | 440/51 |
| 6,375,524 | B1 | * | 4/2002 | Commandeur et al. | 440/54 |

FOREIGN PATENT DOCUMENTS

| | | |
|---|---|---|
| EP | 0 268 711 A1 | 6/1988 |
| EP | 0 888 962 A2 | 1/1999 |
| GB | 1 253 219 | 11/1971 |
| WO | WO 98/33702 | 8/1998 |
| WO | WO 00/07872 | 2/2002 |

* cited by examiner

*Primary Examiner*—S. Joseph Morano
*Assistant Examiner*—Lars A Olson
(74) *Attorney, Agent, or Firm*—Hoffmann & Baron, LLP

(57) ABSTRACT

The present invention provides a large transport ship in which the shape of a ship bottom 1*a* from a bow 1*h* to a stern 1*t*, when viewed on a cross-section perpendicular to the longitudinal direction of the ship bottom 1*a*, is tapered towards the center CL of the ship bottom in the widthwise direction. Consequently, it is possible to resolve problems associated with changes in the draft corresponding to the state of the load, without using ballast water.

12 Claims, 8 Drawing Sheets

LIGHT TRANSPORT SHIP

BACKGROUND OF THE INVENTION

1. Field of the Invention

The present invention relates to a large transport ship such as a tanker, and relates particularly to a large transport ship which does not require ballast.

2. Description of the Background Art

In conventional large transport ships such as tankers, bulk carriers, container ships, LNG carriers and car carriers, a construction is used wherein ballast is loaded onto the ship in order to prevent problems associated with a shallow draft in the case of an empty load, and in order to control the center of gravity.

In other words, if the draft is shallow, problems occur in that; (1) the degree of hogging during navigation is large, and the shearing force and longitudinal bending moment applied to the hull are also large, (2) during navigation, the ship is exposed to the impact of waves striking the ship bottom (so called "slamming"), (3) the propeller cannot be immersed fully, and emerges from the water, which causes a decrease in the propulsion performance, and an increase in the load fluctuation on the propeller and the main engine (causing so called "propeller racing"), and (4) the rudder cannot be submerged sufficiently, causing maneuverability to worsen. In order to resolve these problems, ballast is loaded onto the ship to lower the draft.

Moreover, in this type of large transport ship, in order to ensure a large freight capacity and reduce construction costs, it is standard for the ship bottom to be a flat planar shape.

Furthermore, in a ship hull for which the center of gravity tends to be high, because it is necessary to lower the center of gravity to improve the stabilizing capabilities of the hull, the center of gravity is adjusted by loading ballast into the ship bottom, and conversely, in a ship hull for which the center of gravity tends to be too low in an unloaded state, the center of gravity is adjusted by loading ballast at a high position, to raise the center of gravity of the ship. Furthermore, if the ship heels during loading, it is possible to control the balance of the ship by temporarily loading ballast as a counterweight.

As described above, by loading ballast it is possible to both resolve the above problems associated with a shallow draft, and also appropriately control the center of gravity However, the conventional large transport ships described above suffer from the problems described below.

Namely, in general sea water is used as the ballast, but if the large transport ship takes on this sea water in a loading area, travels to another area of sea, and then dumps the sea water ballast into the sea so that cargo can be loaded at this other site, it is possible that marine species from the sea area in which the ballast was loaded can enter the sea at the other area, potentially changing the ecosystem. Ideas such as replacing the ballast while on the open sea, or sterilizing the ballast water before dumping, have been proposed as solutions to this problem, but these measures are insufficient to resolve this problem completely.

Furthermore, the amount of ballast water depends on the type of ship, but is generally approximately 30% of the displacement of the ship, meaning that the ship carries an unnecessary and unpaid load when in an unloaded state. Consequently, fuel is wasted, which is also a problem from the viewpoint of energy conservation.

In consideration of the above circumstances, an object of the present invention is to provide a large transport ship which can resolve the problems associated with changes in the draft corresponding to the state of the load, without using ballast water.

SUMMARY OF THE INVENTION

A large transport ship according to a first aspect of the present invention comprises a bow, a stern, and a ship bottom, and the shape of the ship bottom from the bow to the stern, when viewed on a cross-section perpendicular to a longitudinal direction of the ship bottom, is tapered towards a center of the ship bottom in a widthwise direction thereof According to the large transport ship of this first aspect, by using a tapered shape for the shape of the ship bottom, the ship can be submerged deeper than a conventional ship with a flat bottom, by an amount equivalent to the reduction in volume achieved by cutting away the edges of the flat bottom.

Consequently, the variety of problems which occur when the draft is shallow (including the increase in the shearing force and longitudinal bending moment applied to the ship due to hogging, slamming, propeller racing, and poor maneuverability and the like) can be avoided.

Furthermore, according to this construction in which the shape of the ship bottom is a tapered shape, because the draft can be deepened without using the conventional ballast water, concern about the effects on an ecosystem of the dumping of ballast water can be eliminated.

In a similar manner, because it is possible to navigate in an unloaded state without loading ballast water, excess fuel is not consumed, which contributes to the move towards more energy efficient transport.

The ship bottom, when viewed in the cross section, may be a V shape formed from straight lines which extend from the center to both edges thereof In this case, because the main section of the ship bottom is formed from two simple planar inclined faces, the construction of the ship bottom is simpler than the case in which the ship bottom is a curved surface.

Either one of a parallel section and a center section of the ship bottom, when viewed in the cross section, may display an angle between inclined faces on each side of the center within a range from 60° to 170°.

Problems may occur if the angle between the two inclined faces on each side of the center exceeds 170°, as the draft cannot be deepened sufficiently, or if the angle is smaller than 60°, as the required displacement cannot be ensured. Consequently, an angle within the range from 60° to 170° is preferable.

A large transport ship according to a second aspect of the present invention comprises a bow, a stern, and a ship bottom, wherein a displacement volume from a center position in a longitudinal direction to the stern is greater than a displacement volume from the center position to the bow.

According to the large transport ship of this second aspect, the front half of the ship, from the center in a longitudinal direction to the bow, can be submerged more deeply than with conventional hulls. Consequently, it is possible to avoid the problems which occur when the draft of the front half of the ship including the bow is shallow (such as the problem of an increase in the shearing force and longitudinal bending moment applied to the ship due to hogging, and the problem of slamming). In addition, in this construction, because the draft can be deepened without using the conventional ballast water, concern about the effects on an ecosystem of the dumping of ballast water can be eliminated. In a similar manner, because it is possible to navigate in an unloaded state without loading ballast water, excess fuel is not consumed, which contributes to the move towards more energy efficient transport.

Furthermore, by ensuring that the displacement of the rear half of the ship from the center in the longitudinal direction to the stern is greater than that of the front half, it is possible to ensure approximately the same total displacement as a conventional ship.

In the first aspect, the large transport ship, a displacement volume from a center position in a longitudinal direction to the stern may be greater than a displacement volume from the center position to the bow.

In this case, the front half of the ship, from the center in a longitudinal direction to the bow, can be submerged more deeply than with conventional hulls. Consequently, it is possible to avoid the problems which occur when the draft of the front half of the ship including the bow is shallow (such as the problem of an increase in the shearing force and longitudinal bending moment applied to the ship due to hogging, and the problem of slamming). In addition, in this construction, because the draft can be deepened without using the conventional ballast water, concern about the effects on an ecosystem of the dumping of ballast water can be eliminated. In a similar manner, because it is possible to navigate in an unloaded state without loading ballast water, excess fuel is not consumed, which contributes to the move towards more energy efficient transport.

Furthermore, by ensuring that the displacement of the rear half of the ship from the center in the longitudinal direction to the stern is greater than that of the front half, it is possible to ensure approximately the same total displacement as a conventional ship.

A large transport ship according to a third aspect of the present invention comprises a bow, a stern, and a ship bottom, and the stern comprises a propulsion mechanism and an elevator which raises and lowers the propulsion mechanism in a vertical direction.

According to the large transport ship of this third aspect, when the draft is comparatively shallow when the ship is in an unloaded state, by lowering the propulsion mechanism, it is possible to fully submerge the propulsion mechanism, and thereby avoid the problem of propeller racing with greater certainty. Conversely, when the draft is comparatively deep when the ship is fully loaded, by raising the propulsion mechanism, the propulsion mechanism can be moved away from the sea floor sufficiently to allow navigation in shallow water. Furthermore, an added benefit of moving the propeller away from the hull by lowering the propulsion mechanism is that the effects of vibration on the hull caused by the propeller can be reduced.

In the first or second aspect, the stern may comprise a propulsion mechanism and an elevator which raises and lowers the propulsion mechanism in a vertical direction.

In this case, in the same manner as the third aspect, when the draft is comparatively shallow when the ship is in an unloaded state, by lowering the propulsion mechanism, it is possible to fully submerge the propulsion mechanism, and thereby avoid the problem of propeller racing with greater certainty. Conversely, when the draft is comparatively deep when the ship is fully loaded, by raising the propulsion mechanism, the propulsion mechanism can be moved away from the sea floor sufficiently to allow navigation in shallow water. Furthermore, an added benefit of moving the propeller away from the hull by lowering the propulsion mechanism is that the effects of vibration on the hull caused by the propeller can be reduced.

A large transport ship according to a fourth aspect of the present invention, either one of a ship bottom, and a ship bottom together with lower side sections of the ship, comprises a buoyancy generator which can be filled with gas.

According to the large transport ship of the fourth aspect, when the ship is in a fully loaded state, it is possible to ensure sufficient buoyancy by filling the buoyancy generator with gas, and furthermore, when the ship is in an unloaded state, by employing a construction in which sea water can flow freely through the buoyancy generator without stagnating, the buoyancy can be decreased and the draft further deepened, and furthermore, marine species are not transported to other sea areas. Consequently, it is possible to control the draft with a greater degree of flexibility according to the state of the load, for example whether the ship is fully loaded or empty, while also preventing the transportation of marine species.

In the large transport ship according to the first, second, or third aspect, either one of the ship bottom, and the ship bottom together with lower side sections of the ship, comprise a buoyancy generator which can be filled with gas.

In this case, in the same manner as the fourth aspect, when the ship is in a fully loaded state, it is possible to ensure sufficient buoyancy by filling the buoyancy generator with gas, and furthermore, when the ship is in an unloaded state, by employing a construction in which sea water can flow freely through the buoyancy generator without stagnating, the buoyancy can be decreased and the draft further deepened, and moreover, marine species are not transported to other sea areas. Consequently, it is possible to control the water level with a greater degree of flexibility according to the state of the load, for example whether the ship is fully loaded or empty, while also preventing the transportation of marine species.

BRIEF DESCRIPTION OF THE SEVERAL VIEWS OF THE DRAWINGS

FIG. 2A to FIG. 2C are diagrams showing the same large transport ship, wherein FIG. 2A is a cross-sectional view along the line A—A in FIG. 1, FIG. 2B is a cross-sectional view along the line B—B in FIG. 1, and FIG. 2C is a cross-sectional view along the line C—C in FIG. 1.

FIG. 6A to FIG. 6C are diagrams showing the large transport ship, wherein FIG. 6A is a cross-sectional view along the line D—D in FIG. 1, FIG. 6B is a cross-sectional view along the line E—E in FIG. 1, and FIG. 6C is a cross-sectional view along the line F—F in FIG. 1.

DETAILED DESCRIPTION OF THE PREFERRED EMBODIMENTS

The present invention relates to a large transport ship with a displacement of greater than 1000 tons such as a tanker, a bulk carrier, a container ship, an LNG carrier or a car carrier, and relates particularly to a large transport ship in which the use of ballast water is unnecessary Embodiments of the present invention are described below with reference to FIG. 1 to FIG. 11, but the present invention is, of course, not limited to these embodiments. Furthermore, features of these embodiments may be combined to each other.

Figure 1:
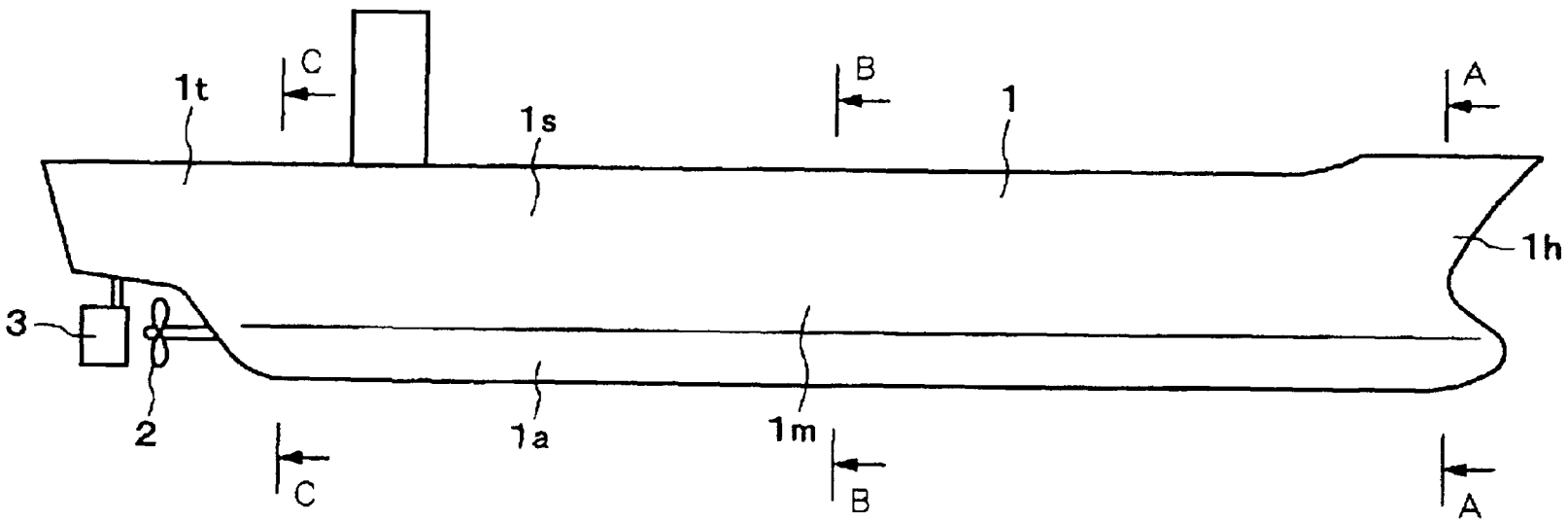
FIG. 1 is a side view showing a first embodiment of a large transport ship according to the present invention.
Figure 2A:
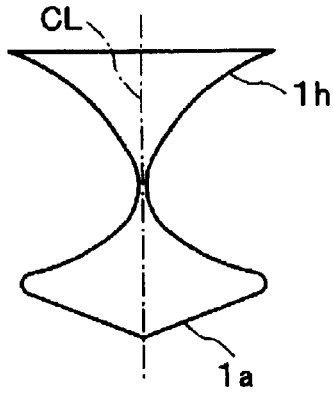
Figure 2B:
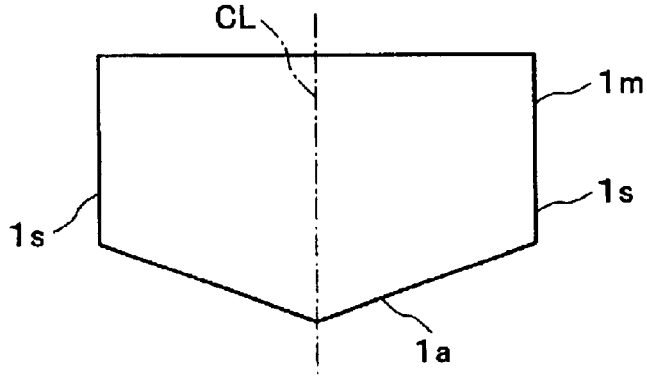
Figure 2C:
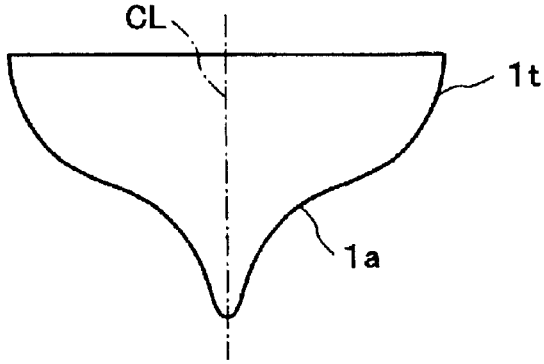
Figure 3:
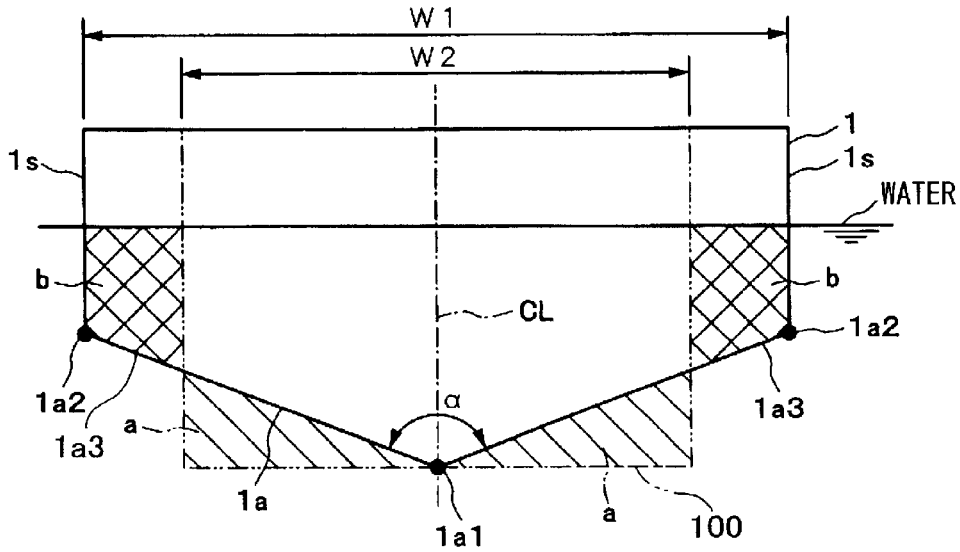
FIG. 3 is a diagram showing the large transport ship in a fully loaded state, viewed in the same cross-section as FIG. 2B.
Figure 4:
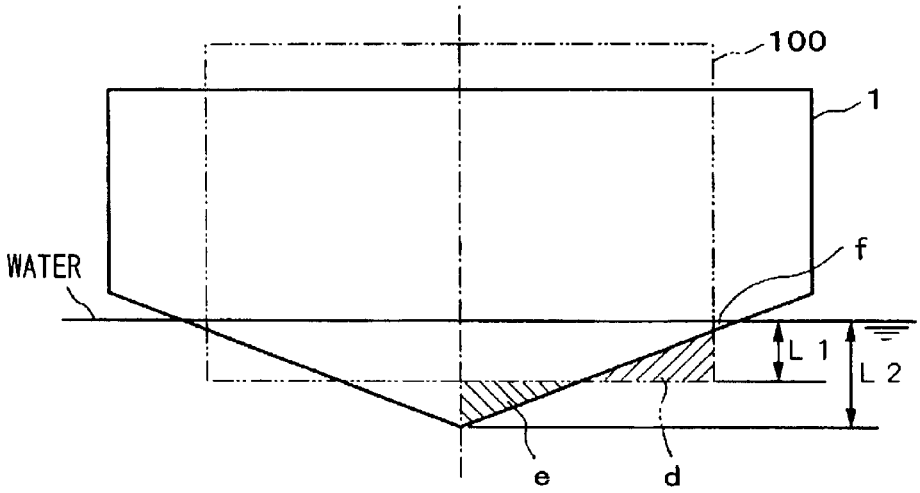
FIG. 4 is a diagram showing the large transport ship in an unloaded state, viewed in the same cross-section as FIG. 2B.

Firstly, a first embodiment of the present invention is described with reference to FIG. 1 through FIG. 4. FIG. 1 is a side view showing a large transport ship according to the present embodiment. Furthermore, FIG. 2A to C are diagrams showing the same large transport ship, wherein FIG. 2A is a cross-sectional view along the line A—A in FIG. 1, FIG. 2B is a cross-sectional view along the line B—B in FIG. 1 and FIG. 2C is a cross-sectional view along the line C—C in FIG. 1. FIG. 3 is a diagram showing the same large transport ship in a fully loaded state, and is a cross-sectional view of the same section shown in FIG. 2B. Furthermore, FIG. 4 is a diagram showing the same large transport ship in an unloaded state, and is a cross-sectional view of the same section shown in FIG. 2B.

In FIG. 1, reference symbol 1 indicates a hull, reference symbol 2 indicates a propeller, and reference symbol 3 indicates a rudder. A bow 1*h* of the hull 1 is on the right side of the figure, the position of the cross-section B—B is a center position 1*m* in a longitudinal direction along the hull 1, and the left side of the figure is the stern 1*t* of the hull 1.

As shown in FIGS. 2A to 2C, in the large transport ship according to the present embodiment, the ship bottom 1*a* (bottom face) from the bow 1*h* to the stern 1*t*, when viewed on a cross-section perpendicular to the longitudinal direction of the hull 1*a*, is a tapered shape tapered towards a center CL of the ship bottom in a widthwise direction. Moreover, labels is indicate side walls which extend vertically upward from both corners of the ship bottom 1*a*.

The details of the tapered shape of the ship bottom 1*a* are described below with reference to FIG. 3, which shows the ship in a fully loaded state. As shown in FIG. 3, when viewed on a cross-section perpendicular to the longitudinal direction, the ship bottom 1*a* is a V shape formed from straight lines extending from the center CL (with a lowest point 1*a*1) to both edges 1*a*2. In addition, this V shape is such that in a parallel section which forms the main section of the ship bottom 1 (in conventional hull shapes, this parallel section refers to the section with the flat bottom. Some hull shapes do not have a parallel section, but in such cases, this section refers to the center in the longitudinal direction of the hull), the angle a between the inclined faces 1*a*3 on each side of the center CL is within a range from 60° to 170°. Incidentally, the hull 100 indicated by the dotted line in the diagram is that of a conventional large transport ship in a fully loaded state with a ship bottom which is a flat planar shape.

The reason the angle a is within the range of 60° to 170° is because if the angle a is greater than 170° the draft cannot be deepened sufficiently, whereas if the angle a is smaller than 60°, the necessary displacement cannot be ensured. Consequently, an angle within the range from 60° to 170° is preferable.

By using a tapered shape for the shape of the ship bottom of the hull 1 as in the present embodiment, the hull 1 can be submerged deeper than the hull 100 with the conventional flat bottom shape by an amount equivalent to the reduction in volume achieved by cutting away the edges of the flat bottom. In other words, in the fully loaded state shown in FIG. 3, by reducing the volume by an amount equivalent to the two corner sections of the flat bottom of the conventional hull 100 (the sections indicated by the hatched lines a, a), a draft L2 which is deeper than the draft L1 of the conventional hull 100, can be achieved in the unloaded state shown in FIG. 4.

In this case, it is possible to compensate for the reduced volume "a" by, for example, adopting a hull width measurement W1 which is wider than the conventional hull width measurement W2, as shown in FIG. 3. In other words, in the fully loaded state, by adopting a hull width measurement W1 which is wider than that of conventional hulls, the volume increases by an amount equivalent to the sections indicated by the double hatched lines b. Furthermore, by adopting a hull width measurement W1 whereby the total volume of the hatched sections "a" is equal to the total volume of the hatched sections "b", a total displacement can be achieved which is the same as that for the conventional hull 100.

This equality of total displacement is maintained even in the unloaded state shown in FIG. 4. In other words, the volume of the hatched section "d" in FIG. 4 is equal to the total volume of the hatched sections "e" and "f".

Moreover, in addition to the aforementioned widening of the hull width measurement W1, other methods of compensating for the displacement of the hatched sections "a" include, adopting a hull length which is longer than the conventional hull 100, lengthening both the hull width measurement W1 and the hull length, or increasing the displacement by raising the height in the vertical direction of the ship when viewed from the front, and deepening the draft. Compensation could also be achieved by increasing the displacement of sections other than the parallel section.

Furthermore, because in the large transport according to the present embodiment, the draft in an unloaded state can be kept deeper than that of the conventional hull 100 while maintaining the same displacement as the conventional hull, the problems which occur when the draft is shallow (such as an increase in the shearing force and longitudinal bending moment applied to the ship due to hogging, slamming, propeller racing and poor maneuverability) can be avoided.

Furthermore, because the draft can be deepened without using ballast water as in conventional ships, by employing the construction in which the shape of the ship bottom is a tapered shape, concern about the effects on ecosystems of the dumping of ballast water can be eliminated.

In a similar manner, because it is possible to navigate in an unloaded state without loading ballast water, excess fuel is not consumed, which contributes to the move towards more energy efficient transport (in other words, it is possible to transport more goods using the same amount of energy).

In addition, by using the construction in which the ship bottom is tapered, it is possible to reduce the degree of impact of slamming against the bottom surface of the ship compared to with a conventional flat ship bottom (conventionally, waves tend to strike the ship bottom perpendicularly, but with the tapered shape of the present invention, waves hit the ship bottom obliquely and are forced out to the sides, thus reducing the impact). The smaller the aforementioned angle a, the more pronounced this impact reducing effect becomes, although as mentioned above, it is preferable that this angle is kept within a range which ensures the necessary displacement.

The effects of the large transport ship according to the present embodiment described above are summarized below.

The large transport ship according to the present embodiment employs a construction in which the shape of the ship bottom 1*a* from the bow 1*h* to the stern 1*t*, when viewed on a cross-section perpendicular to the longitudinal direction of the ship bottom 1*a*, is tapered toward the center CL in the width direction of the ship bottom. According to this construction, because the draft can be kept deeper than that of the conventional flat bottom hull 100, without using ballast water, it is possible to avoid problems which occur due to a shallow draft, and problems which occur due to the use of ballast water, without increasing the displacement in the unloaded state. Consequently, it is possible to solve the problems associated with changes in the draft corresponding to the state of the load, without using ballast water.

Furthermore, the large transport ship according to the present embodiment employs a construction in which the ship bottom 1*a*, when viewed in the aforementioned cross section, is a V shape formed from straight lines extending from the center CL to both sides thereof. According to this construction, because the ship bottom 1*a* comprises, as main structural elements, the two flat inclined faces 1*a*3 the construction is simpler than the case in which the ship bottom is a curved surface, and it is therefore possible to lower the construction cost of the large transport ship.

Furthermore, the large transport ship according to the present embodiment employs a construction in which the ship bottom 1*a*, when viewed in the aforementioned cross section, displays an angle a between the two inclined faces 1*a*3 on either side of the center of the ship bottom, which falls within the range from 60° to 170°. According to this construction, it is possible to deepen the draft sufficiently, while at the same time ensuring the necessary displacement.

Moreover, although the joints between both sides of the ship bottom 1*a* and the side walls 1*s* are angular in this embodiment, construction is not restricted to this shape, and the joints could also be gradual curves.

Figure 5:
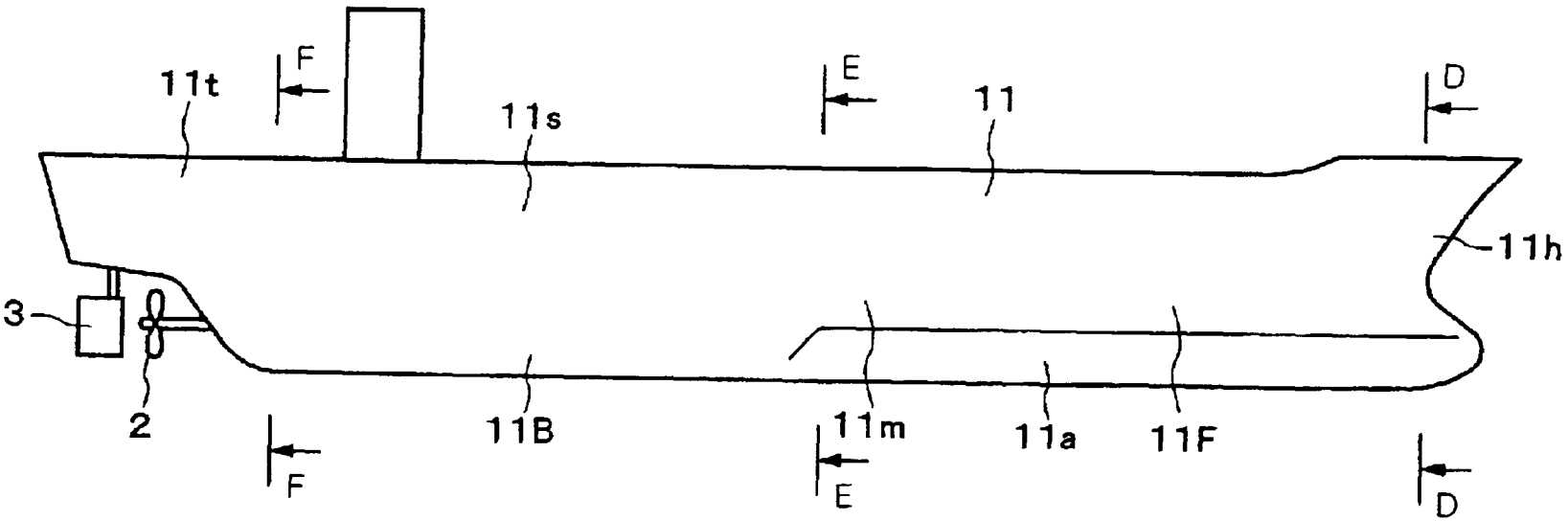
FIG. 5 is a side view of a second embodiment of a large transport ship of the present invention.
Figure 6A:
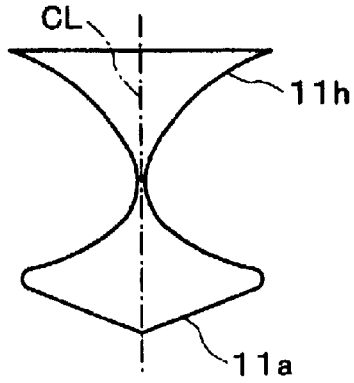
Figure 6B:
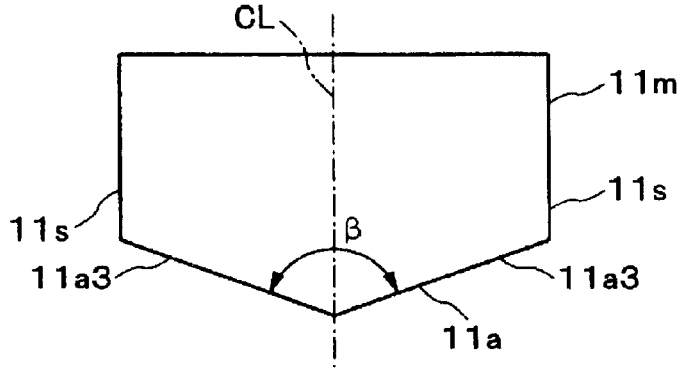
Figure 6C:
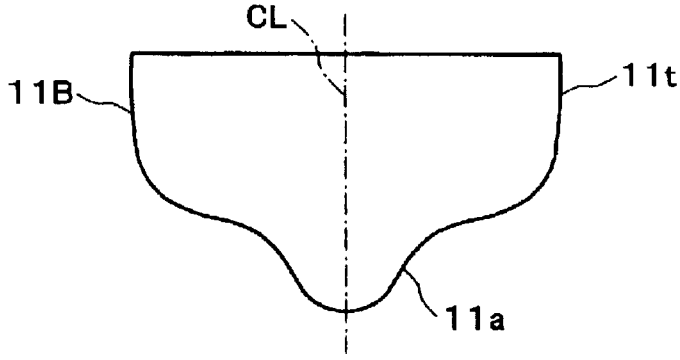
Figure 7:
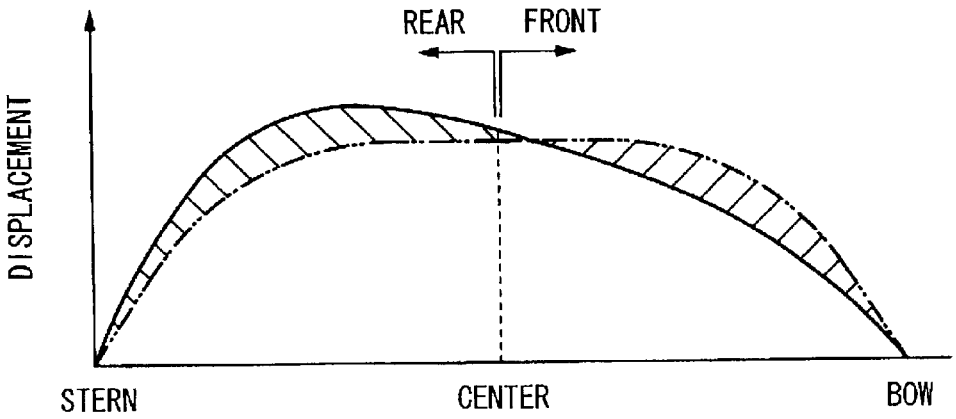
FIG. 7 is a diagram showing the displacement distribution along the longitudinal direction of the large transport ship, wherein the horizontal axis indicates the position along the longitudinal direction of the hull, and the vertical axis indicates the displacement.

Next, a second embodiment of a large transport ship according to the present invention is described with reference to FIG. 5 through FIG. 7. FIG. 5 is a side view showing the large transport ship according to the present embodiment. Furthermore, FIGS. 6A to C are diagrams showing the same large transport ship, wherein FIG. 6A is a cross-sectional view along the line D—D in FIG. 1, FIG. 6B is a cross-sectional view along the line E—E in FIG. 1, and FIG. 6C is a cross-sectional view along the line F—F in FIG. 1. Moreover, FIG. 7 is a diagram showing the displacement distribution along the longitudinal direction of the same large transport ship, in which the horizontal axis shows the position on the hull in the longitudinal direction, and the vertical axis shows the displacement.

Those structural elements which are identical with those of the first embodiment are described using the same labels.

In FIG. 5, reference symbol 11 indicates a hull, reference symbol 2 indicates a propeller, and reference symbol 3 indicates a rudder. The right side of the diagram is the bow 11*h* of the hull 11, the position of the cross-section along the line E—E is the center position 11*m* in a longitudinal direction along the hull 11, and the left side of the diagram is the stern 11*t* of the hull 11.

As shown in FIG. 6A and FIG. 6B, when viewed on a cross-section perpendicular to the longitudinal direction of the hull 1*a*, the shape of the front half 11F of the large transport ship according to the present embodiment, from the center position 11*m* in the longitudinal direction of the ship bottom (bottom face) to the bow 11*h*, is tapered toward the center CL in the width direction of the ship bottom. Moreover, the labels 11*s* indicate side walls which extend vertically upwards from each edge of the ship bottom 11*a*.

The details of the tapered shape of the front section 11F of the hull 11*a* are the same as the hull 1*a* described in the first embodiment, with a V shape formed from straight lines extending from the center CL to both edges thereof, when viewed on a cross-section perpendicular to the longitudinal direction of the hull. In addition, in the same manner as the aforementioned angle a, an angle b between the two inclined faces 11*a*3 on each side of the center CL falls within a range from 60° to 170° within the parallel section of the hull.

By employing this tapered front section 11F, the hull can be submerged more deeply (the draft can be deepened in the unloaded state) than conventional hulls with flat bottoms, for the same reasons described for the first embodiment.

Consequently, it is possible to avoid the problems which occur when the draft of the front half 11F of the ship including the bow 11*h* is shallow (such as the problem of an increase in the shearing force and longitudinal bending moment applied to the ship due to hogging, and the problem of slamming). In addition, because the draft can be deepened without using the conventional ballast water, concern about the effects on an ecosystem of the dumping of ballast water can be eliminated. In a similar manner, because it is possible to navigate in an unloaded state without loading ballast water, excess fuel is not consumed, which contributes to the move towards more energy efficient transport.

In addition, in the present embodiment, the parallel section of the rear half 11B of the ship bottom 11*a* is a flat planar shape. Consequently, as shown by the solid line in FIG. 7, the displacement distribution in the longitudinal direction is such that the displacement of the rear half section 11B is greater than that of the front half section 11F.

In this manner, by ensuring a displacement for the rear half section 11B which is greater than that of the front half section 11F, the rear half section 11B compensates for the reduction in displacement of the front half section 11B, and it is possible to achieve approximately the same total displacement as a conventional ship (in other words, in FIG. 7, if the dotted line is the displacement distribution of a conventional hull, then in the hull 11 of the present embodiment, the displacement of the front half section 11F is shifted towards the rear half section 11B, although the total displacement is approximately the same as the conventional hull).

The effects of the large transport ship according to the present embodiment described above are summarized below.

The large transport ship according to the present embodiment employs a construction in which the displacement of the ship bottom 11*a* from the center position in the longitudinal direction to the stern 11*t* is greater than the displacement of the ship bottom 11*a* from the center position to the bow 11*h*. According to this construction, because the draft of the front half section 11F can be kept deeper than that of a conventional flat bottom hull, without using ballast water, it is possible to avoid problems which occur due to a shallow draft, and problems which occur due to the use of ballast water, without increasing the displacement in the unloaded state. Consequently, it is possible to solve the problems associated with changes in the draft corresponding with the state of the load, without using ballast water.

Furthermore, the combined displacement of those sections removed from the ship bottom 11*a* in order to achieve the tapered shape can be compensated for by increasing the displacement of the rear half section 11B of the ship bottom 11*a*, so that it is possible to ensure approximately the same total displacement as a conventional hull.

Moreover, in the present embodiment, the displacement of the front half section 11F was reduced to a smaller value than that of the rear half section 11B by adopting a tapered shape for the front half section 11F of the ship bottom 11*a*. However the present embodiment is not limited to this construction, and the same effect may also be achieved by other measures such as producing a width of the front half section 11F which is narrower than the width of the rear half section 11B.

Figure 8A:
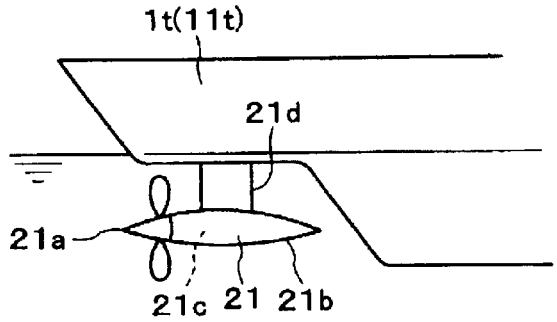
FIG. 8A and FIG. 8D are partial enlargements showing the stern section according to a third embodiment of a large transport ship of the present invention.
Figure 8B:
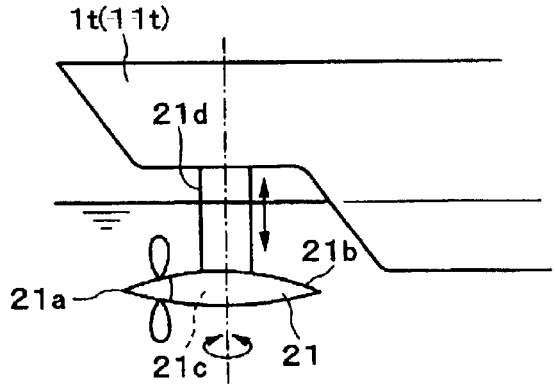

Next, a third embodiment of the large transport ship of the present invention is described below with reference to FIGS. 8A and 8B. FIG. 8A and FIG. 8B are partial enlargements showing the stern section of the large transport ship of the present embodiment.

A characteristic of the present embodiment is that instead of the aforementioned propeller 2 and the rudder 3 of the first and second embodiments, the stern 1*t* (11*t*) is equipped with a Pod propulsion device 21 (a propulsion mechanism also known as a T drive, a duck drive, a Z propeller, or a Z drive) which can be raised and lowered, as shown in FIG. 8A and FIG. 8B.

This Pod propulsion device 21 comprises a propeller 21*a*, a casing 21*b*, a motor 21*c*, which is housed inside the casing 21*b*, and a rudder section 21*d* which supports the casing 21*b* on the stern 1*t* (11*t*) and functions as a rudder. Moreover, in addition to this rudder section 21*d*, the propulsive force of the propeller 21*a* also acts as a rudder.

This Pod propulsion device 21 can steer the ship through the generation of a propulsive force by using the motor 21*c* to rotationally drive the propeller 21*a*, and by altering the direction of the propeller 21*a* and the rudder section 21*d* about a vertical axis.

In the large transport ship of the present embodiment, when the draft is comparatively shallow when the ship is in an unloaded state, as in FIG. 8A, by lowering the Pod propulsion device 21, it is possible to fully submerge the Pod propulsion device 21, and thereby avoid the problem of propeller racing with greater certainty. Conversely, when the draft is comparatively deep when the ship is fully loaded, as in FIG. 8B, by raising the Pod propulsion device 21, the Pod propulsion device 21 can be moved away from the sea floor sufficiently to allow navigation in shallow water. Consequently, it is possible to solve the problems associated with changes in the draft corresponding with the state of the load, without using ballast water.

Furthermore, an added benefit of lowering the Pod propulsion device 21 and moving the propeller 21*a* away from the hull is that the effects of vibration on the hull caused by the propeller 21*a* can be reduced.

Moreover, in the present embodiment, a Pod propulsion device 21 in which the motor 21*c* is housed inside the casing 21*b* was used. However the present embodiment is not limited to this configuration, and a configuration in which an engine is installed inside the stern 1*t* (11*t*), and the propulsion of this engine is transmitted to the propeller 21*a* via a power transmission mechanism may also be used (not shown in the diagram).

Furthermore, the present embodiment was described using a hull with a tapered ship bottom 1*a* (11*a*). However the present embodiment is not limited to this configuration, and a configuration in which the Pod propulsion device 21 of the present embodiment is used with a conventional flat bottom hull may also be used.

Figure 9:
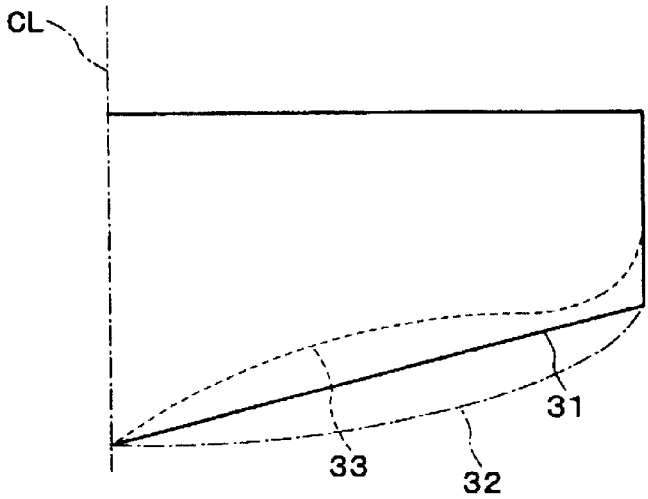
FIG. 9 shows a fourth embodiment of a large transport ship of the present invention, and is a cross-sectional view at the center position in a longitudinal direction along the hull.

Next, a fourth embodiment of the present invention is described below with reference to FIG. 9. FIG. 9 shows a large transport ship according to the present embodiment, and is a cross-sectional view at the center position in the longitudinal direction along the hull.

As shown in FIG. 9, in the first embodiment through the third embodiment, the ship bottom 1*a* (11*a*) was a linear tapered shape (reference symbol 31), but in the present embodiment, a downward convex curve shape as denoted by reference symbol 32 or an upward convex curve shape as denoted by reference symbol 33 may be used.

The downward convex curve shape shown by reference symbol 32 has the advantage of being stronger than the other shapes, whereas the upward convex curve shape shown by reference symbol 33 has the advantage that it enables a deeper draft to be achieved.

Figure 10:
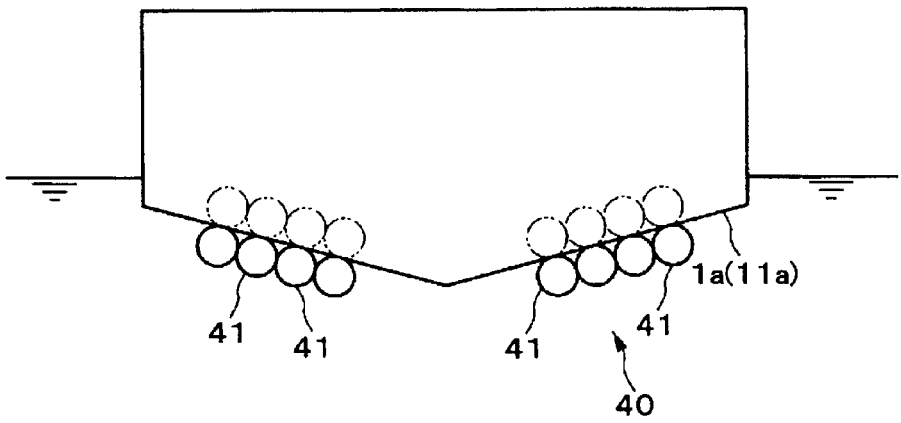
FIG. 10 shows a fifth embodiment of a large transport ship of the present invention, and is a cross-sectional view at the center position in the longitudinal direction along the hull.
Figure 11:
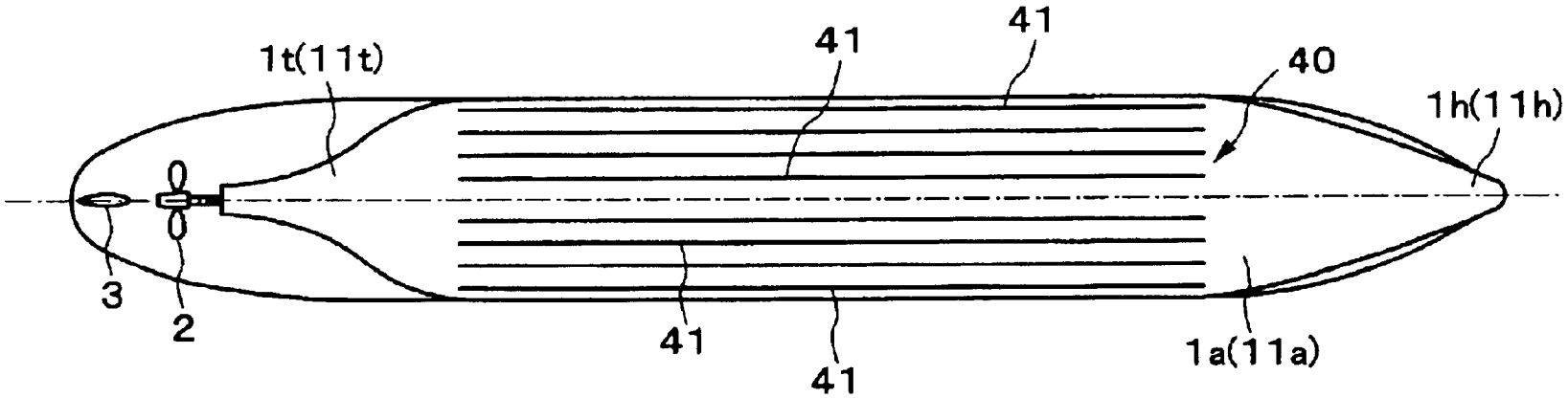
FIG. 11 is a diagram showing the ship bottom of the large transport ship.

Next, a fifth embodiment of a large transport ship of the present invention is described with reference to FIG. 10 and FIG. 11. FIG. 10 shows the large transport ship according to the present embodiment, and is a cross-sectional view at the center position in the longitudinal direction along the hull. Furthermore, FIG. 11 is a diagram showing the ship bottom of the same large transport ship.

A feature of the present embodiment is that a buoyancy generator 40, which can be filled with gas, is provided on the ship bottom 1*a* (11*a*) of one of the first through fourth embodiments.

This buoyancy generator 40 comprises a plurality of long tube shaped pipes 41, an air filling mechanism (not shown in the drawings) for filling these pipes 41 with air, and an opening and closing mechanism (not shown in the drawings) for opening and closing the ends of the pipes 41.

The pipes 41 are secured in parallel along the longitudinal direction of the ship bottom 1*a* (11*a*), and the openings on both the front end and the rear end of the pipes 41 are opened and closed by the opening and closing mechanism.

In the large transport ship according to the present embodiment, in the fully loaded state, by closing both ends of the pipes 41 using the opening and closing mechanism, and filling the interior of the pipes 41 with air using the air filling mechanism, it is possible to ensure sufficient buoyancy.

Furthermore, in an unloaded state, by opening both ends of each pipe 41 using the opening and closing mechanism and exhausting the air inside, it is possible to reduce the buoyancy and further deepen the draft. Consequently, it is possible to control the draft with a greater degree of flexibility according to the volume of cargo, for example, whether the ship is in the fully loaded state or the unloaded state. Moreover, when the ship is operated with the opening and closing mechanism open, sea water passes through the inside of each pipe 41, and so the ship behaves as if the pipes 41 did not exist.

Furthermore, in the present embodiment, by employing straight pipes 41 in which fluid has no place to become stagnant, it is difficult for water deposits to pool inside the pipes, and so it is possible to prevent negative effects such as the transporting of such water deposits to a different sea area where they may affect other ecosystems.

Moreover, the present embodiment was described using an example in which the plurality of pipes 41 are exposed on the exterior of the hull. However the present embodiment is not limited to this example, and for example, a plurality of through holes running along the direction of travel may be formed in the hull itself, as shown by the dotted lines in FIG. 10, and these through holes may be used instead of the pipes 41.

Furthermore, the present embodiment was described using an example in which the buoyancy generator 40 was positioned only on the ship bottom 1*a* (11*a*). However the present embodiment is not limited to this example, and the buoyancy generator 40 may be positioned on both the ship bottom 1*a* (11*a*) and the lower side sections of the ship.

What is claimed is:

1. A large transport ship comprising a bow, a stern, and a ship bottom, wherein the shape of the ship bottom from the bow to the stern, when viewed on a cross-section perpendicular to a longitudinal direction of the ship bottom, is tapered towards a center of the ship bottom in a widthwise direction thereof, and wherein a displacement volume from a center position in a longitudinal direction to the stern is greater than a displacement volume from the center position to the bow so that the displacement volume from the center position to the stern compensates for a reduction in the displacement volume from the center position to the bow, and wherein the large transport ship has a total displacement of no less than 1000 tons.

2. A large transport ship according to claim 1, wherein the ship bottom, when viewed in the cross section, is a V shape formed from straight lines which extend from the center to both edges thereof.

3. A large transport ship according to claim 1, wherein either one of a parallel section and a center section of the ship bottom, when viewed in the cross section, displays an angle between inclined faces on each side of the center within a range from 60° to 170°.

4. A large transport ship according to claim 1, wherein either one of the ship bottom, and the ship bottom together with lower side sections of the ship, comprises a buoyancy generator which can be filled with gas for controlling the draft of the large transport ship.

5. A large transport ship according to claim 1, wherein the stern comprises a propulsion mechanism and an elevator which raises and lowers the propulsion mechanism in a vertical direction for adjusting the depth of the propulsion mechanism under water.

6. A large transport ship according to claim 5, wherein the propulsion mechanism includes a casing that contains a motor therein.

7. A large transport ship according to claim 5, wherein the propulsion mechanism includes a movable casing that contains a motor and a rudder section which supports the movable casing on the stern and functions as a rudder.

8. A large transport ship according to claim 1, wherein the ship bottom from a center position to the stern has a flat planar shape and from a center position to the bow has a V-shape when viewed on a cross-section perpendicular to a longitudinal direction of the ship bottom.

9. A large transport ship, wherein either one of a ship bottom, and a ship bottom together with lower side sections of the ship, comprises a buoyancy generator which can be filled with gas for controlling the draft of the large transport ship, wherein the buoyancy generator comprises a plurality of long tube shaped pipes and an air filling mechanism for filling the pipes with air, and wherein the buoyancy generator further comprises an opening and closing mechanism for opening and closing the ends of the pipes.

10. A large transport ship according to claim 9, wherein the large transport ship has a displacement of no less than 1000 tons.

11. A large transport ship, wherein either one of a ship bottom, and a ship bottom together with lower side sections of the ship, comprises a buoyancy generator which can be filled with gas for controlling the draft of the large transport ship, wherein the buoyancy generator comprises a plurality of long tube shared pipes and an air filling mechanism for filling the pipes with air, and wherein the pipes are secured in parallel along the longitudinal direction of the ship bottom.

12. A large transport ship according to claim 11, wherein the large transport ship has a displacement of no less than 1000 tons.

* * * * *

UNITED STATES PATENT AND TRADEMARK OFFICE

CERTIFICATE OF CORRECTION

PATENT NO. : 6,769,372 B2
DATED : August 3, 2004
INVENTOR(S) : Sato et al.

It is certified that error appears in the above-identified patent and that said Letters Patent is hereby corrected as shown below:

Title page, Item [54] and Column 1, line 1,
Title, now reads "LIGHT TRANSPORT SHIP" should read -- LARGE TRANSPORT SHIP --

Column 4,
Line 61, now reads "FIG. 8A and FIG. 8D" should read -- FIG. 8A and FIG. 8B --

Column 5,
Line 45, now reads "labels is indicate" should read -- labels 1s indicate --

Column 12,
Line 36, now reads "tube shared pipes" should read -- tube shaped pipes --

Signed and Sealed this

First Day of February, 2005

JON W. DUDAS
*Director of the United States Patent and Trademark Office*